US006364601B1

(12) United States Patent
Picarello et al.

(10) Patent No.: US 6,364,601 B1
(45) Date of Patent: Apr. 2, 2002

(54) STRADDLE TYPE CONTAINER LIFTING DEVICE

(75) Inventors: Joseph F. Picarello, Howell; Charles A. Domino, Toms River, both of NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/599,962

(22) Filed: Jun. 23, 2000

(51) Int. Cl.[7] ..... B66C 1/00; B66C 3/00

(52) U.S. Cl. ..... 414/803; 414/392; 414/460; 414/561; 294/670 DA; 294/81.1; 294/81.53

(58) Field of Search ..... 414/392, 458, 414/459, 460, 561, 803; 294/670 DA, 81.1, 81.53

(56) References Cited

U.S. PATENT DOCUMENTS 3,945,673 A * 3/1976 Visser ..... 294/67 DA
3,993,202 A 11/1976 Neitzel
4,358,239 A 11/1982 Dechantsreiter
4,551,059 A * 11/1985 Petoia ..... 414/459
4,595,224 A * 6/1986 Kaup ..... 294/81.2
5,174,708 A * 12/1992 Ruder et al. ..... 414/392
5,379,863 A 1/1995 Sugawara
5,409,346 A 4/1995 Grether
5,509,774 A 4/1996 Yoo
5,586,619 A 12/1996 Young
5,722,511 A 3/1998 Wakamiya
5,758,747 A 6/1998 Okazaki et al.
5,829,948 A 11/1998 Becklund
5,984,050 A 11/1999 Ronald

* cited by examiner

*Primary Examiner*—Eileen D. Lillis
*Assistant Examiner*—Charles A. Fox
(74) *Attorney, Agent, or Firm*—Mark Homer

(57) ABSTRACT

A lifting apparatus including a horizontal framework, a pair of extension assemblies, a pair of upper, middle, and lower telescoping mast assemblies, and two pairs of fork tine assemblies is provided. Each pair of the extension assemblies, the telescoping mast assemblies, and the fork tine assemblies is identical to the other one in structure and function. The horizontal framework is coupled to an overhead bridge crane and is accessible to any load located within a minimum amount of aisle space.

15 Claims, 5 Drawing Sheets

16
18
20
31
31
15
19
17
14
22
21
12
13
21
11
22
10
14
17
19
15
31
31
20
16
18
250

STRADDLE TYPE CONTAINER LIFTING DEVICE

BACKGROUND OF THE INVENTION

1. Field of the Invention

The present invention relates to a lifting apparatus, and more particularly to a lifting apparatus of adjusting spaced-apart tines to fit a load depending on the fork pocket spacing, height, and width of the load.

2. Brief Description of the Prior Art

Fork tines have been used for lifting and moving a load. Typically, fork tines mounted on a frame of a lifting apparatus are spaced-apart from each other. Because a height of the frame and a distance between fork tines are fixed, the lifting apparatus is limited to use for lifting and carrying a fixed-sized load. A plurality of lifting apparatuses and a bulky and complicated lifting apparatus have been used for the various sized loads. Moreover, depending on various sizes of a width, a height, and a length of the loads, the lifting apparatus having only one dimensional adjustment is not enough to lift and move the various sized loads.

In efforts of adjusting a distance between fork tines or a height of the frame in the lifting apparatus, U.S. Pat. No. 5,984,050 for a Carriage Suspension For Lift Truck issued to Ronald, U.S. Pat. No. 5,829,948 for a Multipurpose Lift Apparatus and Method issued to Becklund, U.S. Pat. No. 5,758,747 for a Mast Support for Forklift issued to Okazaki et al., U.S. Pat. No. 5,722,511 for a Lifting Vehicle and Method of Operating the Vehicle issued to Wakamiya, U.S. Pat. No. 5,586,619 for a lifting Apparatus issued to Young, U.S. Pat. No. 5,509,774 for a Load Clamping apparatus with an Increased Extent of Vertical Movement issued to Yoo, U.S. Pat. No. 5,379,863 for a Crane issued to Sugawara et al., U.S. Pat. No. 5,409,346 for a Self-Loading and Unloading Forklift Truck issued to Grether, U.S. Pat. No. 4,358,239 for a Warehouse Crane Including Inclinable Tote Pan Puller issued to Dechantsreiter, and U.S. Pat. No. 3,993,202 for a Storage System With Adjustable Interconnected Crane Towers issued to Neitzel disclose various types of lifting apparatuses having the fork tines. These references, however, show mechanisms adjusting only one dimension of the fork tines depending on the size of the load or complicated mechanisms adjusting one or two dimensions of the fork tines and including a tractor or a truck.

Regarding screw jack mechanisms, U.S. Pat. No. 5,118,082 for a Electrical Operated Screw-Type Jack issued to Byun, U.S. Pat. No. 4,641,813 for a Dual Automobile Jack For Consumer Use issued to Arzouman, and U.S. Pat. No. 4,609,179 for a Screw Jack issued to Chem et al. disclose typical structures of screw jacks. These references, however, do not show any application for a lifting apparatus.

Therefore, we have noticed that the conventional method and apparatus fail to show a lifting apparatus having a variable range of the width, height, and length of the frame and the fork tines depending on various sizes of width, height, and fork pocket spacing of the loads and that the lifting apparatus as shown in these references are not enough to lift and move various sized loads in width, height, and length. Moreover, when the various sized loads should be located in a limited space or a designated storage location, the conventional lifting apparatus can not move within the space and carry the various sized loads into the limited space.

SUMMARY OF THE INVENTION

It is an object of the present invention to provide a lifting apparatus suitable to lift and carry all various sized loads.

It is another object of the present invention to provide a lifting apparatus able to load a container into a limited space and a designated storage location.

It is yet another object to provide a lifting apparatus able to adjust to any width, height, and fork pocket spacing.

It is still another object to provide a lifting apparatus able to adjust a frame to fit a load.

It is a further object to provide a lifting apparatus able to access a load within a minimum amount of aisle space.

It is also another object to provide a lift apparatus able to adjust all of the width, the height, and fork pocket spacing of the frame or fork tines simultaneously.

These and other objects may be achieved by providing a lifting apparatus including a horizontal framework, two pairs of extension assemblies, a pair of upper, middle, and lower telescoping mast assemblies, and two pair of fork tine assemblies. Each one of the pairs of the extension assemblies, the telescoping mast assemblies, and the fork tine assemblies is identical to the other one in structure and function. The horizontal framework is coupled to an overhead bridge crane and is accessible to any load located within a minimum amount of aisle space.

The horizontal framework includes a pair of horizontal supporters spaced-apart from each other and a pair of horizontal connectors secured to both ends of the horizontal supporters. Two brackets fixed between the spaced-apart horizontal supporters connected to the bridge crane trolley by securing to hooks or twist lock connectors of the bridge crane trolley to brackets.

A horizontal motor mounted on one of the horizontal supporters is connected to a frame shaft through a first shaft extended from the horizontal motor, to a pulley and belt assembly. The frame shaft is coupled to a pair of gear reduction units mounted on the horizontal supporter. The output end of each gear reduction unit is coupled to a pulley and belt assembly. Each pair of pulley and belt assemblies directs torque to a pair of inboard pinion gears and outboard pinion gears, both of which operate in synchronized motion through a final pulley and belt drive.

All of the extension assemblies, the upper, middle, and lower telescoping masts, and fork tine assemblies move toward or from the horizontal framework. Therefore, a distance between pairs of extension assemblies, the upper, middle, and lower telescoping masts, and fork tine assemblies is adjusted by the rotation of the horizontal motor and the frame shaft pulleys, belts and pinion gears.

The upper mast assembly is mounted beneath the extension supporter and includes two upper vertical beams spaced-apart from each other and two upper horizontal side bars attached to the spaced-apart upper vertical beams to maintain a distance between the spaced-apart upper vertical beams. Pairs of rails are formed on the upper vertical beams. A vertical motor mounted on the extension supporter is coupled to vertical screws within the power screw jack through a second shaft extended from the vertical motor. The vertical screws are rotatably mounted on the upper vertical assembly. Ends of the vertical screws are coupled to the second shaft within the power screw jacks while the other ends of the vertical screw are inserted into holes formed on the middle horizontal beam through fixed nuts attached to the middle horizontal beam. A thread portion formed inside of the fixed nut is coupled to a peripheral outside of the vertical screw.

A middle mast assembly coupled to the vertical screw of the upper mast assembly through the fixed nut includes two middle vertical beams spaced-apart from each other and two middle horizontal beams attached to spaced-apart middle vertical beams to maintain a distance between spaced-apart middle vertical beams. Two pairs of rails formed on the two middle vertical beams have a telescoping relationship with each pair of rails of upper vertical beams.

A lower mast assembly includes two lower vertical beams spaced-apart from each other and lower horizontal beams, each end coupled to spaced-apart lower. vertical beams. A lifting chain is coupled to both the upper and lower mast assemblies through a pulley rotatably mounted on the middle horizontal beam of the middle mast assembly. An anchor is secured to the lower horizontal beam. The lifting chain has one end connected to the anchor and the other end connected to the lower horizontal side bar of the upper mast assembly while a portion of the lifting chain is wound around a peripheral surface of the pulley. A fork tine assembly is mounted on the lower mast assembly, and two fork tines are spaced-apart from each other by a pair of tine motors and power screw drive-shafts mounted on the lower mast assembly.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter an embodiment according to the principle of the present invention will be described in detail with reference to accompanying drawings.

Figure 1:
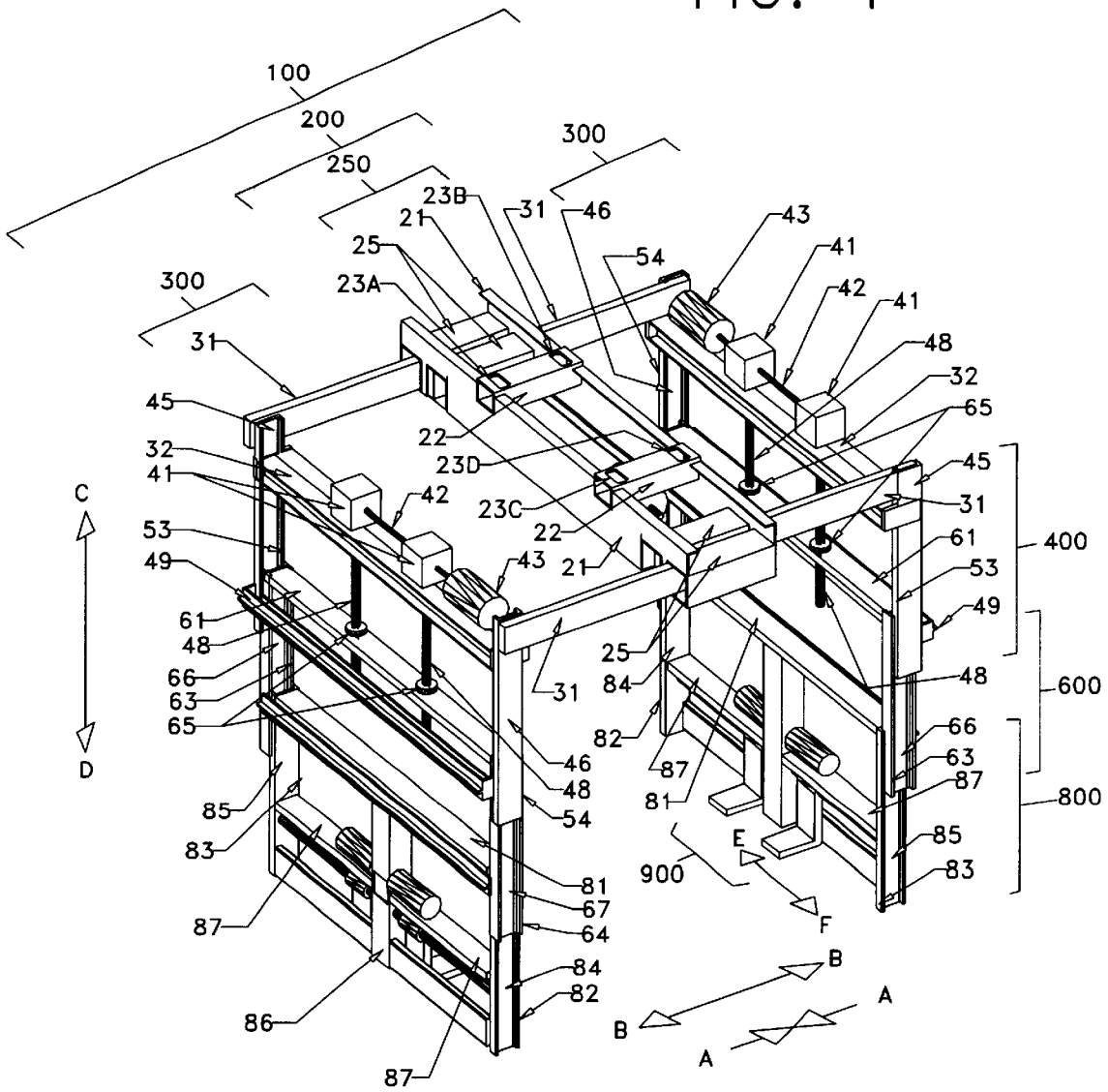
FIG. 1 is a perspective view showing a lifting device according to the principle of the present invention.

Referring now to FIG. 1, a container lifting device 100 includes a horizontal framework 200, a horizontal drive mechanism 250, a pair of extension assemblies 300, each with a pair of upper, middle, and lower telescoping mast assemblies 400, 600, 800, and a pair of fork tine assemblies 900. Each one of the pair of extension assemblies 300, telescoping mast assemblies 400, 600, 800, and fork tine assemblies 900 is identical to the other one in structure and function.

The horizontal framework 200 defines a pair of horizontal supporters 21 spaced-apart from each other and a pair of horizontal connectors 25 secured to both ends of the horizontal supporters 21. Two brackets 22 are fixed between spaced-apart horizontal supporters 21 and include connecting holes 23A thru D connected to twist lock connectors of a bridge crane trolley not shown. Lifting device 100 is connected to the bridge crane trolley by securing the connector fittings of the bridge crane trolley to connecting holes 23A thru D in lifting device 100.

Figure 6:
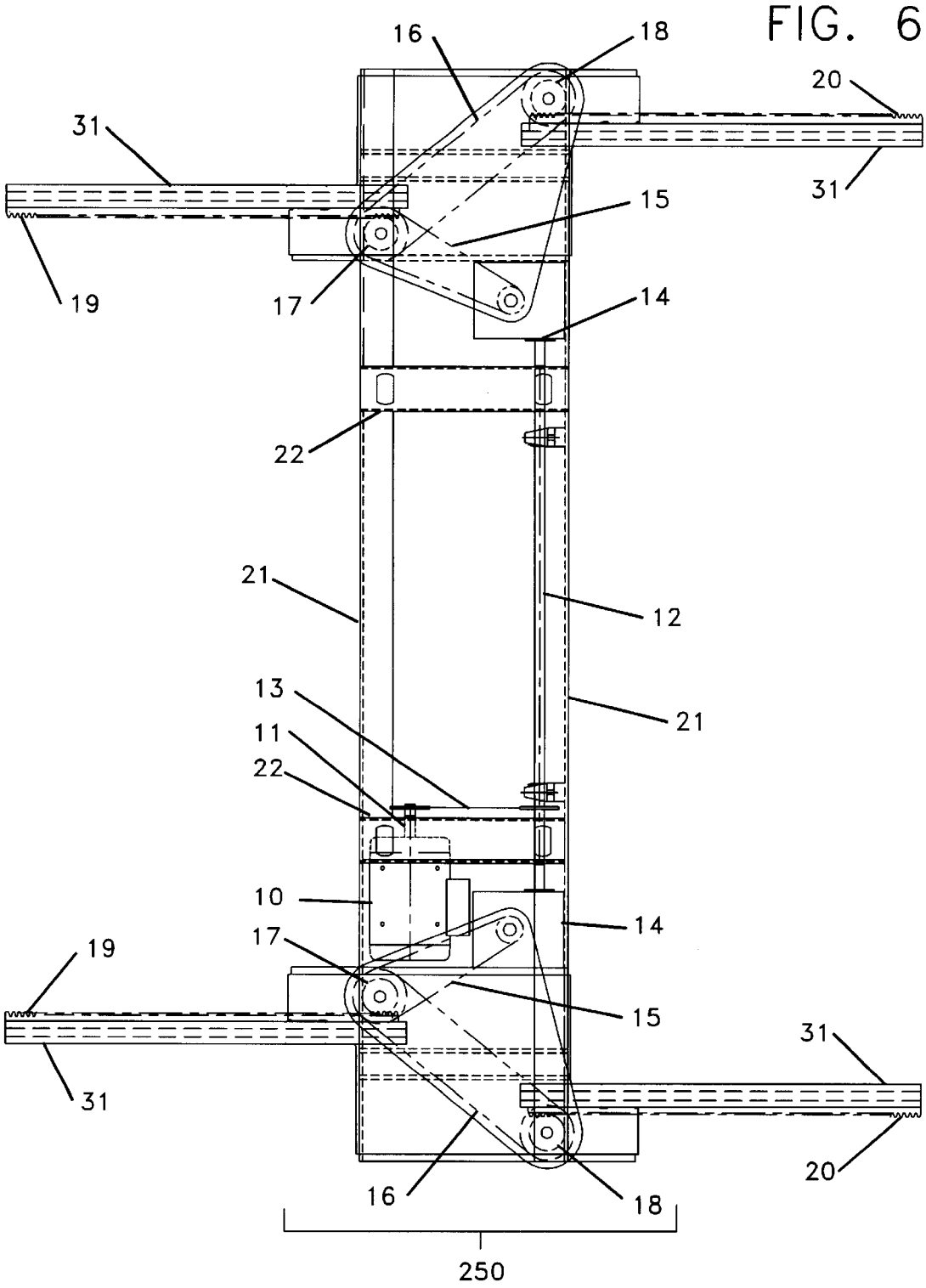
FIG. 6 is a view illustrating the horizontal drive mechanism of the lifting device.

The horizontal drive mechanism 250 is more fully depicted in FIG. 6. A horizontal motor 10 is mounted on one of horizontal supporters 21. A first shaft 11 extended from horizontal motor 10 is connected to a frame shaft 12 through a pulley and belt assembly 13. The frame shaft 12 is coupled to a pair of speed reduction gear units 14 on opposite ends of the frame shaft 12. The speed reduction gear units are connected to a pair of pulley and belt assemblies 15. Pulley and belt assemblies 15 direct power to inboard pinion gears 17 and outboard pinion gears 18 in synchronized motion through the use of pulley and belt drive assemblies 16. Each of the pinion gears 17 and 18 moves a matching gear rack 19 and 20 rigidly attached to horizontal carriages 31. One end of the horizontal carriages 31 are fixed to extension supporters 32 while the other end of horizontal carriages 31 are inserted into horizontal connectors 25. Both pairs of horizontal carriages 31 move smoothly, and the same distance, within horizontal connectors 25 during the movement resulting from matching gear racks 19 and 20. Therefore, referring again to FIG. 1, extension assemblies 300 remain horizontally spaced-apart by an equal, predetermined distance from horizontal drive mechanism 250 based upon the system described above.

If a wide container is lifted, each one of extension assemblies 300, upper, middle, and lower telescoping masts 400, 600, 800, and fork tine assemblies 900 moves in the direction of arrow "B" thereby widening the distance between each pair to fit the width of the wide container. If the lifting device 100 lifts a narrow container, each one of extension assemblies 300, upper, middle, and lower telescoping masts 400, 600, 800, and fork tine assemblies 900 moves in the direction of arrow "A" thereby narrowing the distance between each pair to fit the width of the narrow container. Depending on the width of a container, the width of lifting device 100 is adjusted to fit the width of the container.

Since each one of the pair of extension assemblies 300, upper, middle, and lower telescoping masts 400, 600, 800, and fork tine assemblies 900 is identical to the other pair in structure and function, only one of each pair is explained and described hereinafter.

Upper mast assembly 400 is mounted beneath of extension supporter 32 and defines two upper vertical beams 45 and 46 spaced-apart from each other and having upper ends attached to beneath of extension supporter 32. One upper horizontal side bar 49 is attached to spaced-apart upper vertical beams 45 and 46 to maintain a common distance. Pairs of rails 53, 54 are formed on upper vertical beams 45 and 46.

A vertical motor 43 is mounted on extension supporter 32. Second shaft 42 extended from vertical motor 43 is inserted into second power screw jacks 41 and coupled to vertical screws 48 rotatably mounted on middle telescoping mast assembly 600. Vertical screws 48 rotate by the rotation of second shaft 42 and vertical motor 43. One end of vertical screws 48 are coupled to second shaft 42 through second power screw jacks 41 while the other end of vertical screws 48 are inserted into holes formed on the middle horizontal beam 61 through fixed nuts 65 fixed on middle horizontal beam 61. A thread portion formed inside of fixed nut 65 is coupled to a teeth portion formed on the peripheral outside of vertical screw 48.

Middle mast assembly 600 is coupled to vertical screw 48 of upper mast assembly 400 through fixed nut 65 and defines two middle vertical beams 66 and 67 spaced-apart from each other and three middle horizontal beams 61, 68, and 69 attached to vertical beams 66 and 67 to maintain a common distance between them. Two pairs of rails 63 and 64 formed on the two middle vertical beams 66 and 67 have a telescoping relationship with each pair of rails 53 and 54 of upper vertical beams 45 and 46. Rotation of vertical screws 48 causes fixed nuts 65 coupled to thread portion of vertical screws 48 to move up and down along vertical screws 48 in a direction of an arrow "C" or "D" depending on a rotating direction of vertical screw 48. Since fixed nut 65 is fixed to middle horizontal beam 61 and moves along vertical screw 48 in the direction of arrow "C" or "D" middle vertical beams 66 and 67 slidably move along inside of upper vertical beams 45 and 46. Thus, middle mast assembly 600 moves up toward and down from extension supporter 32.

Figure 2:
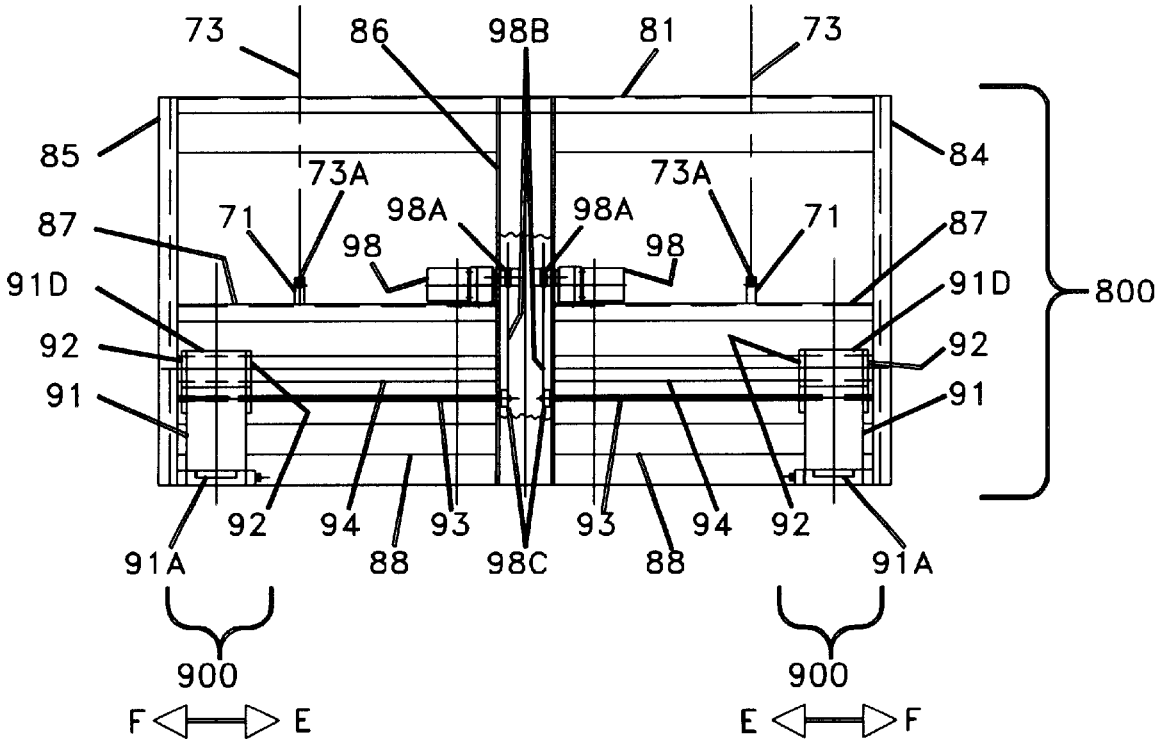
FIG. 2 is a partial cross-sectional view illustrating a lower mast assembly of the lifting device.
Figure 3:
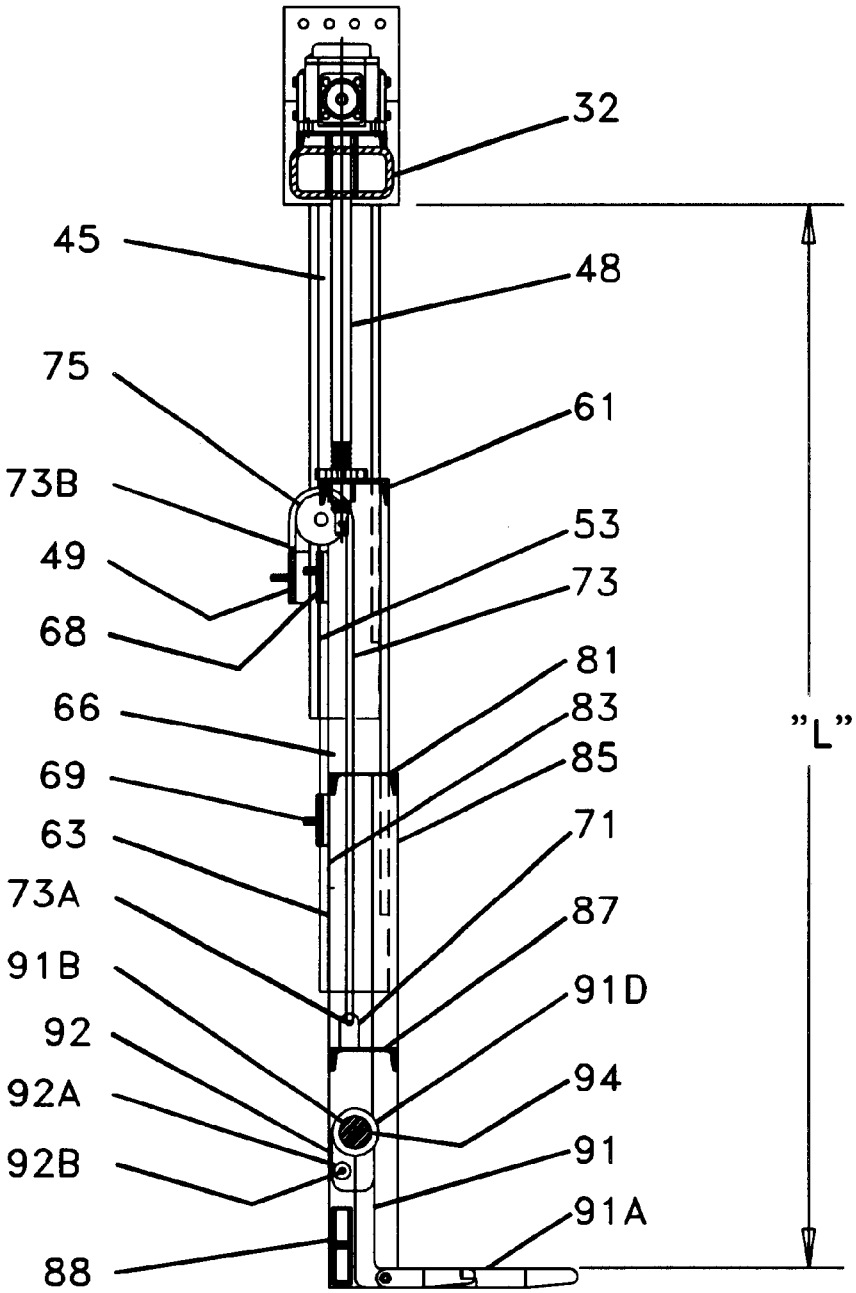
FIG. 3 is a partial cross-sectional view illustrating a maximum height of a vertical lifting assembly of the lifting device.

As shown in FIGS. 1 through 3, lower mast assembly 800 defines two lower vertical beams 84 and 85 spaced-apart from each other by lower horizontal beams 81 and 87. A lifting chain 73 is coupled to both upper and lower mast assemblies 400 and 800 through a pulley 75 rotatably mounted on middle horizontal beam 61 of middle mast assembly 600. An anchor 71 is secured to lower horizontal beam 87. Lifting chain 73 has one end 73A connected to anchor 71 and the other end 73B connected to upper horizontal side bar 49 of upper mast assembly 400 while a portion of lifting chain 73 is wound around the peripheral surface of pulley 75.

When middle mast assembly 600 moves up along vertical screw 48 toward extension supporter 32 in the direction of arrow "C" pulley 75 moves away from upper horizontal side bar 49 and moves toward extension supporter 32. Since lifting chain 73 is wound around pulley 75 mounted on middle horizontal beam 61 of middle mast assembly 600, and each end 73A and 73B of lifting chain 73 is coupled to lower horizontal beam 87 of lower mast assembly 800 and upper horizontal side bar 49 of upper mast assembly 400 respectively, lower mast assembly 800 moves toward middle and upper. mast assemblies 600 and 400 and extension supporter 32 if middle mast assembly 600 moves up toward upper mast assembly 400 and extension supporter 32. In this position,. pulley 75 is located approximately half-way along lift chain 73. On the contrary, if middle mast assembly 600 moves. down from upper mast assembly 400 and extension supporter 32 in the direction of arrow "D", lower mast assembly 800 moves away from middle and upper mast assemblies 600 and 400 and extension supporter 32. In this position, pulley 75 is located adjacent to a portion of the other end 73B of lifting chain 73.

Figure 4:
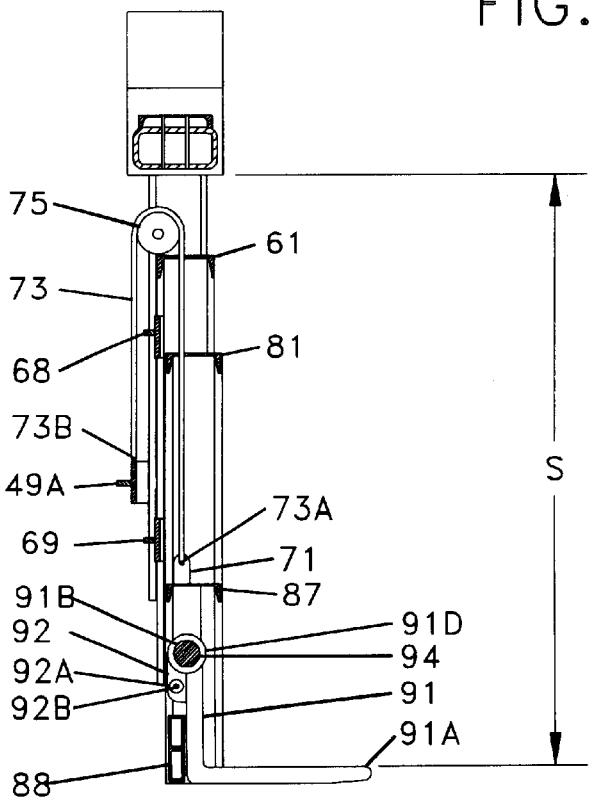
FIG. 4 is a partial cross-sectional view illustrating a minimum height of a vertical lifting assembly of the lifting device.

Therefore, a height of the telescoping mast assembly including upper, middle, and lower mast assemblies 400, 600, 800 can be adjusted depending on the height of a container or a load. A maximum height "L" of the telescoping mast assembly is shown in FIG. 3 while a minimum height "S" of the telescoping mast assembly which telescopes is shown in FIG. 4. Rail 83 of lower vertical beam 85 slides into inside of rail 63 of middle vertical beam 66 which slides into inside of rail 53 of upper vertical beam 45 while rail 82 of lower vertical beam 84 slides over the outside surface of rail 64 of middle vertical beam 67 which slides over the outside surface of rail 54 of upper vertical beam 46 during adjusting the height of the telescoping mast assembly.

The width of lifting apparatus 100 is adjusted by horizontal motor 10, horizontal framework 200, and extension assembly 300 while the height of lifting apparatus 100 is adjusted by vertical motor 43 and the telescoping mast assembly including upper, middle, and lower mast assemblies 400, 600, 800. Instead of horizontal motor 10, frame shaft 12, a pair of hydraulic or pneumatic cylinders can be mounted on horizontal supporter 21 of horizontal frame work 200 or extension supporter 32 of extension assembly 300. If the cylinders are mounted on horizontal supporter 21 of horizontal frame work 200, a shaft extended from the cylinder is connected to each extension supporter 32 of extension assembly 300. If the cylinders are mounted on extension supporter 32 of extension assembly 300, the shaft extended from the cylinder is connected to each horizontal supporter 21 of horizontal frame work 200.

Figure 5:
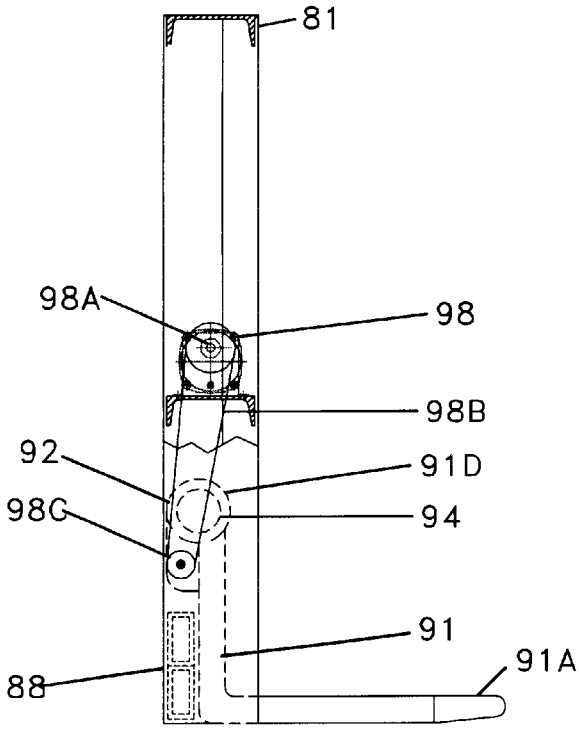
FIG. 5 is a partial cross-sectional view illustrating a fork tine assembly of the lifting device.

Referring now to FIGS. 2, 4, and 5, a fork tine assembly 900 is mounted on lower mast assembly 800. A pair of tine motor 98 are mounted on lower horizontal supporter 87 of lower mast assembly 800. Longitudinal fork screw 93 is rotatably mounted on spaced-apart lower vertical beam 85 and internal vertical beam 86 and is connected to tine motor 98 through a shaft 98A, a pulley and belt 98B, and a pulley 98C. A traveling frame 92 having a thread hole 92A and two spaced-apart guide. protrusions 92B is coupled to a thread portion of fork screw 93 and moves in a direction of an arrow "E" or "F" by rotation of fork screw 93. Two ends of tine axle 94 are fixed to spaced-apart lower vertical beam 85 and internal vertical beam 86 respectively after tine axle 94 is inserted into tine hole 91B formed on head portion 91D of fork tine 91. Head portion 91D of fork tine 91 is located between two spaced-apart guide protrusions 92B of traveling frame 92. Fork tine 91 slides along tine axle 94 by movement of traveling frame 92 and moves in the same direction of guide protrusions 92B of traveling frame 92. Tine body supporter 88 is disposed to support fork tine 91 during loading a container or a load on tine extensions 91A of fork tine 91 thereby preventing fork tine 91 from rotating about an axis of tine axle 94.

Depending on the fork pocket locations of the container, the distance between fork tines 91 can be adjusted by fork tine assembly 900 to fit the container fork pocket spacing when fork tines 91 move in the direction of arrow "E" or "F". Therefore, the width, height, and fork tine spacing of lifting apparatus 100 are adjusted by horizontal motor 10, horizontal framework 200, and extension assembly 300, vertical motor 43 and the telescoping mast assemblies 400, 600, and 800, and fork tine assembly 900 respectively depending on the width and height of the container and spacing of its fork pockets.

As described in the above, there are advantages in the lifting apparatus for adjusting the width, height, and fork tine spacing of the lifting apparatus according to the principle of the present invention in that the lifting device includes a great amount of adjustability to handle various unit load heights and tine positions that allow the lifting device to load containers having different dimensions into a fixed, narrow space.

What is claimed is:

1. A lifting device, comprising:

a horizontal framework having a pair of horizontal supporters connected to a pair of horizontal connectors;

at least a pair of horizontal carriages slidably inserted into said horizontal connectors approximately perpendicular to said horizontal supporters;

a horizontal drive mechanism, comprising a pulley and belt system, wherein said horizontal drive mechanism may move said horizontal carriages within said horizontal connectors, wherein the pulley and belt system comprises:

a first shaft connected to said horizontal motor;

a frame shaft having first and second ends connected to said first shaft;

a pair of speed reduction gear units wherein said speed reduction gear units connect to said first and second ends of said frame shaft;

a pair of pulley and belt drive assemblies connected to said pair of speed reduction gear units;

a pair of inboard pinion gears and a pair of outboard pinion gears driven in synchronized motion through said pulley and belt drive assemblies; and, a pair of gear racks moved by said pair of inboard and said pair of outboard pinion gears wherein said gear racks move said extension supporters horizontally;

at least a pair of extension units disposed on opposite sides of said horizontal supporters and connected to said horizontal carriages wherein said extension units remain approximately parallel when said horizontal drive mechanism moves said horizontal carriages toward or away from said horizontal framework;

at least a telescoping mast unit having a plurality of telescoping mast assemblies, connected to said extension unit and approximately perpendicular to said horizontal framework, vertically moving toward and away from said extension unit; and at least a fork tine assembly mounted on one of said telescoping mast assemblies, having at least a pair of tines spaced-apart from each other.

2. The lifting device of claim 1, further comprising a bracket that allows said horizontal framework to connect to a bridge crane.

3. The lifting device of claim 2, wherein said horizontal drive mechanism further comprises a horizontal motor to drive the pulley and belt system.

4. The lifting device of claim 3, further comprising:

a vertical motor connected to said telescoping mast assembly wherein said vertical motor vertically moves said telescoping mast assembly toward and away from said extension unit.

5. The lifting device of claim 4, wherein said telescoping mast assembly comprises:

an upper mast assembly connected to said extension unit and approximately perpendicular to said horizontal framework;

a middle mast assembly, having a rotatable pulley, telescoped into said upper mast assembly and connected to said upper assembly through at least a vertical screw connected to said vertical motor wherein said vertical motor rotates said vertical screw to vertically move said middle mast assembly; and a lower mast assembly, having a lifting chain with a first and second end, said chain connected to said upper mast assembly and said lower mast assembly wherein vertical movement of said middle mast assembly results in vertical movement of said lower mast assembly.

6. The lifting device of claim 5, wherein said telescoping mast assembly further comprises:

a pulley rotatably mounted on said middle mast assembly, said lifting chain wound around said pulley;

said first end of said lifting chain connected to lower mast assembly; and said second end of said lifting chain connected to said upper mast assembly.

7. The lifting device of claim 6, wherein said telescoping mast unit further comprises a power screw jack coupling said vertical motor to said vertical screw.

8. The lifting device of claim 7, wherein said telescoping mast assembly further comprises a fixed nut mounted on said middle mast assembly, coupled to said vertical screw, movable along said vertical screw when said vertical motor rotates said vertical screw.

9. The lifting device of claim 8, wherein said fork tine assembly comprises at least a tine motor connected to said tines wherein said tine motor moves said tines toward and away from each other.

10. The lifting device of claim 9, wherein said fork tine assembly further comprises:

a fork screw having a thread portion, connected to said tine motor, rotatably mounted on said lower mast assembly;

a traveling frame coupled to said thread portion of said fork screw wherein said traveling frame moves approximately planer to said lower mast assembly when said fork screw rotates; and, a guide protrusion extended from said traveling frame, moving said tines.

11. The lifting device of claim 10, wherein said fork tine assembly further comprises:

at least a tine hole formed on said tines; and, at least a tine axle inserted into said tine hole, connected to said lower mast assembly, wherein said tines slide along said tine axle through the movement of said traveling frame.

12. The lifting device of claim 11, wherein said fork tine assembly further comprises a tine body supporter mounted on said lower mast assembly, disposed to support said tine and prevent said tine from rotating about said tine axle.

13. The lifting device of claim 12, further comprising two pairs of horizontal carriages, each of said pairs of horizontal carriages inserted into said horizontal connectors.

14. The lifting device of claim 13, further comprising:

two extension units; and, two telescoping mast assemblies connected to said extension units.

15. The lifting device of claim 14, further comprising two fork tine assemblies, each fork tine assembly mounted on the lower mast assembly of said telescoping mast assemblies wherein said fork tine assemblies face each other.

* * * * *

UNITED STATES PATENT AND TRADEMARK OFFICE

CERTIFICATE OF CORRECTION

PATENT NO. : 6,364,601 B1
DATED : April 2, 2002
INVENTOR(S) : Picarello et al.

It is certified that error appears in the above-identified patent and that said Letters Patent is hereby corrected as shown below:

Title page,
Item [*] Notice, delete the phrase "by 0 days" and insert -- by 41 days --

Signed and Sealed this

Twenty-eighth Day of September, 2004

JON W. DUDAS
*Director of the United States Patent and Trademark Office*